US010804647B2

(12) United States Patent
Kitagawa

(10) Patent No.: US 10,804,647 B2
(45) Date of Patent: Oct. 13, 2020

(54) CIRCUIT BOARD CONNECTOR DEVICE

(71) Applicant: HIROSE ELECTRIC CO., LTD., Tokyo (JP)

(72) Inventor: Ryohei Kitagawa, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/661,192

(22) Filed: Oct. 23, 2019

(65) Prior Publication Data

US 2020/0136306 A1 Apr. 30, 2020

(30) Foreign Application Priority Data

Oct. 24, 2018 (JP) ..... 2018-200098

(51) Int. Cl.
*H01R 13/629* (2006.01)
*H01R 13/405* (2006.01)
*H01R 12/71* (2011.01)

(52) U.S. Cl.
CPC ..... *H01R 13/629* (2013.01); *H01R 12/716* (2013.01); *H01R 13/405* (2013.01)

(58) Field of Classification Search
CPC ..... H01R 12/716
See application file for complete search history.

(56) References Cited

U.S. PATENT DOCUMENTS 7,726,979 B2 * 6/2010 Lei ..... H01R 12/716 439/74
9,190,751 B2 * 11/2015 Miyazaki ..... H01R 12/716
9,728,882 B1 8/2017 Nakazawa

FOREIGN PATENT DOCUMENTS

JP 2017-204433 A 11/2017
JP 2018-073747 A 5/2018

* cited by examiner

*Primary Examiner* — Ross N Gushi
(74) *Attorney, Agent, or Firm* — Rankin, Hill & Clark LLP

(57) ABSTRACT

A first connector and a second connector engageably connected to or disengaged from each other along an engagement direction are provided. The first connector includes a first housing and primary and secondary first terminal groups each having multiple first terminals. The second connector includes a second housing and primary and secondary second terminal groups each having multiple second terminals.

20 Claims, 9 Drawing Sheets

CIRCUIT BOARD CONNECTOR DEVICE

CROSS-REFERENCE TO RELATED APPLICATION

This application claims priority from Japanese Patent Application No. 2018-200098 filed with the Japan Patent Office on Oct. 24, 2018, the entire content of which is hereby incorporated by reference.

BACKGROUND

1. Technical Field

One aspect of the present disclosure relates to a circuit board connector device.

2. Related Art

There is a circuit board connector device including first and second connectors engageably connected to or disengaged from each other. In this circuit board connector device, when the first connector and the second connector in an engageable connection state are disengaged from each other, the first connector and the second connector are preferably linearly separated from each other in a direction along a normal engagement direction, such as a direction perpendicular to both of a mounting surface of the first connector and a mounting surface of the second connector. In a case where the connectors are not separated linearly, but one connector is separated in a state (an inclined state) inclined with respect to the other connector, more specifically a case where one end side of one connector is rotatably moved to the other end side relative to the other connector such that these connectors are separated from each other, an unexpected load is on engagement portions of the first connector and the second connector and terminals arranged at these engagement portions. For this reason, there are a probability that the engagement portions and the terminals are damaged and a probability that terminal contact force is weakened. In a case where some of the terminals are provided as elastic protruding portions in a protruding state in the engagement portions, the above-described probabilities become higher.

As described above, the first connector and the second connector are preferably separated linearly. However, as pointed out in, e.g., JP-A-2017-204433 and JP-A-2018-73747, the first connector and the second connector are actually separated not linearly but in the inclined state in many cases. That is, for linearly separating the first connector and the second connector, one and the other end sides of one connector need to be simultaneously lifted relative to the other connector. Such a process is extremely complicated. With connector size reduction, the first connector and the second connector are often separated in the inclined state accidentally. More specifically, in a case where each of the first connector and the second connector is connected to a circuit board, these connectors are hidden by the circuit board. For this reason, it is difficult for a user to visually check the connectors. As a result, the user forgets that the first connector and the second connector are in the engageable connection state, and brings the first connector and the second connector into the inclined state unintentionally.

The techniques disclosed in JP-A-2017-204433 and JP-A-2018-73747 are for solving a problem caused because the first connector and the second connector are brought into the inclined state in disengagement of the first connector and the second connector. For example, an object of the technique of JP-A-2017-204433 is to prevent curling of a first terminal even when the force of inclining the second connector is provided with respect to the first connector. An object of the technique of JP-A-2018-73747 is to reduce cancellation of a connector engagement state and connector electric connection in such a force application state.

SUMMARY

A circuit board connector device includes: a first connector and a second connector engageably connected to or disengaged from each other along an engagement direction, wherein the first connector includes a first housing having a portion along the engagement direction, a portion along a first length direction perpendicular to the engagement direction, and a portion along a first width direction, and a primary first terminal group and a secondary first terminal group each having multiple first terminals held on the first housing and arrayed along the first length direction, the second connector includes a second housing having a portion along the engagement direction, a portion along a second length direction perpendicular to the engagement direction, and a portion along a second width direction, and a primary second terminal group and a secondary second terminal group each having multiple second terminals held on the second housing and arrayed along the second length direction, the first housing of the first connector includes a protruding wall standing toward a side of engagement between the first connector and the second connector in the engagement direction and extending along the first length direction, a first peripheral wall standing toward the engagement side in the engagement direction and surrounding an outer periphery of the protruding wall in the first length direction and the first width direction, and a first receiving portion recessed to a side opposite to the engagement side in the engagement direction and positioned between the protruding wall and the first peripheral wall in the first length direction and the first width direction, the primary and secondary first terminal groups of the first connector are each arrayed along the first length direction, and are arranged facing each other with the protruding wall being interposed therebetween in the first width direction, each first terminal includes a first contact portion and a raised curved portion protruding to the engagement side in the engagement direction, the raised curved portion is provided with the raised curved portion being exposed through the first housing, the second housing of the second connector includes a second peripheral wall standing toward the side of engagement between the first connector and the second connector in the engagement direction, arranged in an annular shape in the second length direction and the second width direction, and fitted in the first receiving portion in engageable connection between the first connector and the second connector, and a second receiving portion recessed to the side opposite to the engagement side in the engagement direction, formed inside the second peripheral wall in the second length direction and the second width direction, and configured such that the protruding wall is fitted in the second receiving portion in engageable connection between the first connector and the second connector, the primary and secondary second terminal groups of the second connector are each arrayed along the second length direction, and are arranged facing each other with the second receiving portion being interposed therebetween in the second width direction, each second terminal includes a second contact portion fitted in the first receiving portion in engageable connection between the first connector and the second connector to contact the first contact portion of a corresponding one of the first terminals, and a connection portion protruding outward of the second peripheral wall in the second width direction, a collision surface projecting outward in the first width direction with respect to a top portion of the raised curved portion protruding most to the engagement side and extending along the first length direction is provided on the engagement side of the first peripheral wall, the collision surface is provided in an outer region in the first length direction with respect to an array range of the first terminals included in the primary first terminal group and an outer region in the first length direction with respect to an array area of the first terminals included in the secondary first terminal group, a projecting portion is provided on a side opposite to the engagement side of the second peripheral wall, projects outward in the second width direction with respect to the second peripheral wall, and extends along the second length direction, and at least part of the projecting portion collides with the collision surface in disengagement of the first connector and the second connector.

DETAILED DESCRIPTION

Figure 1:
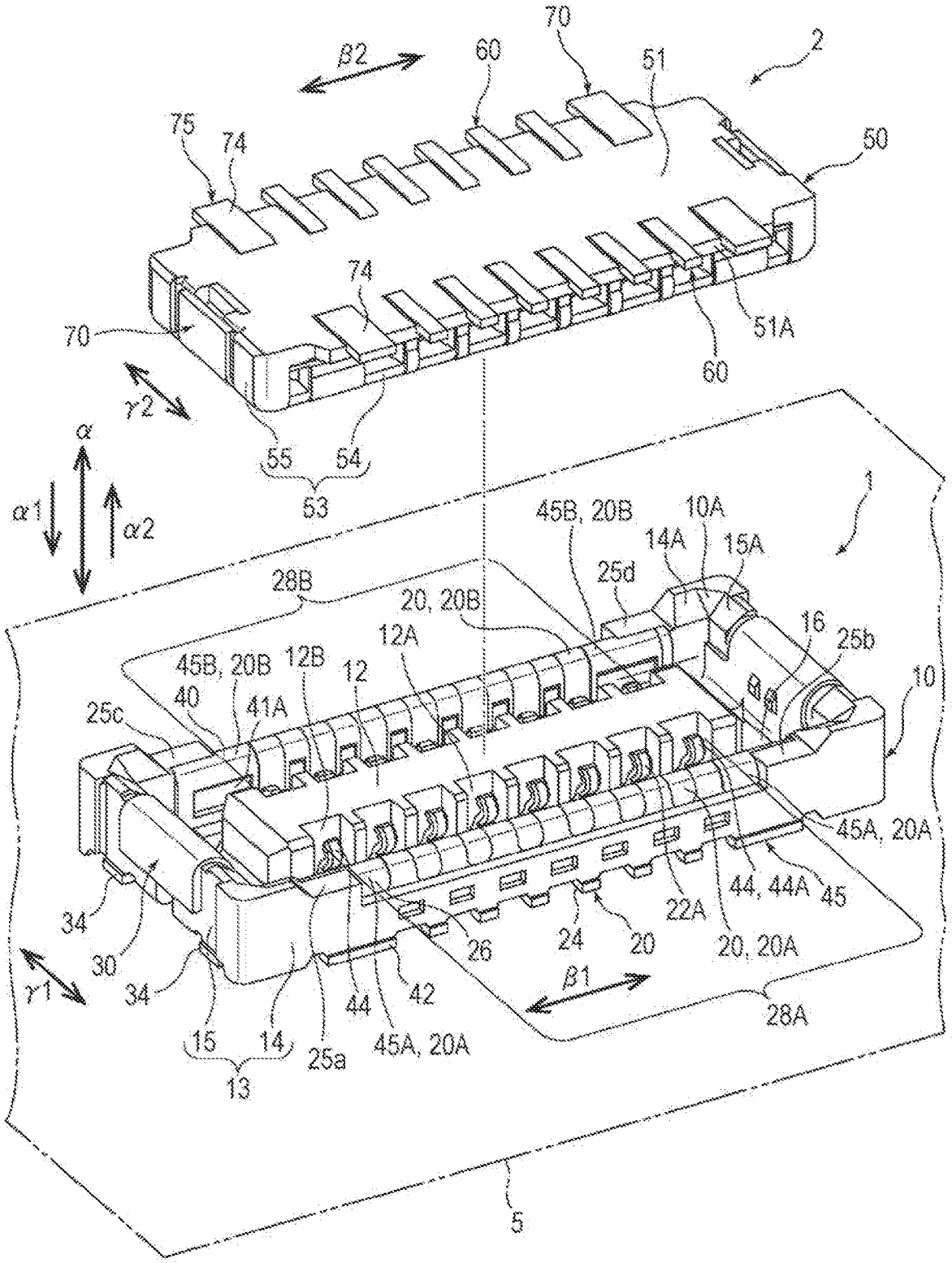
FIG. 1 is a perspective view of a state before engageable connection of a receptacle connector and a plug connector included in a circuit board connector device according to the present embodiment or after disengagement of the receptacle connector and the plug connector.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

A circuit board connector device according to one aspect of the present disclosure includes: a first connector and a second connector engageably connected to or disengaged from each other along an engagement direction, wherein the first connector includes a first housing having a portion along the engagement direction, a portion along a first length direction perpendicular to the engagement direction, and a portion along a first width direction, and a primary first terminal group and a secondary first terminal group each having multiple first terminals held on the first housing and arrayed along the first length direction, the second connector includes a second housing having a portion along the engagement direction, a portion along a second length direction perpendicular to the engagement direction, and a portion along a second width direction, and a primary second terminal group and a secondary second terminal group each having multiple second terminals held on the second housing and arrayed along the second length direction, the first housing of the first connector includes a protruding wall standing toward a side of engagement between the first connector and the second connector in the engagement direction and extending along the first length direction, a first peripheral wall standing toward the engagement side in the engagement direction and surrounding an outer periphery of the protruding wall in the first length direction and the first width direction, and a first receiving portion recessed to a side opposite to the engagement side in the engagement direction and positioned between the protruding wall and the first peripheral wall in the first length direction and the first width direction, the primary and secondary first terminal groups of the first connector are each arrayed along the first length direction, and are arranged facing each other with the protruding wall being interposed therebetween in the first width direction, each first terminal includes a first contact portion and a raised curved portion protruding to the engagement side in the engagement direction, the raised curved portion is provided with the raised curved portion being exposed through the first housing, the second housing of the second connector includes a second peripheral wall standing toward the side of engagement between the first connector and the second connector in the engagement direction, arranged in an annular shape in the second length direction and the second width direction, and fitted in the first receiving portion in engageable connection between the first connector and the second connector, and a second receiving portion recessed to the side opposite to the engagement side in the engagement direction, formed inside the second peripheral wall in the second length direction and the second width direction, and configured such that the protruding wall is fitted in the second receiving portion in engageable connection between the first connector and the second connector, the primary and secondary second terminal groups of the second connector are each arrayed along the second length direction, and are arranged facing each other with the second receiving portion being interposed therebetween in the second width direction, each second terminal includes a second contact portion fitted in the first receiving portion in engageable connection between the first connector and the second connector to contact the first contact portion of a corresponding one of the first terminals, and a connection portion protruding outward of the second peripheral wall in the second width direction, a collision surface projecting outward in the first width direction with respect to a top portion of the raised curved portion protruding most to the engagement side and extending along the first length direction is provided on the engagement side of the first peripheral wall, the collision surface is provided in an outer region in the first length direction with respect to an array range of the first terminals included in the primary first terminal group and an outer region in the first length direction with respect to an array area of the first terminals included in the secondary first terminal group, a projecting portion is provided on a side opposite to the engagement side of the second peripheral wall, projects outward in the second width direction with respect to the second peripheral wall, and extends along the second length direction, and at least part of the projecting portion collides with the collision surface in disengagement of the first connector and the second connector.

One object of the present disclosure is to provide the following circuit board connector device. The circuit board connector device includes first and second connectors engageably connected to or disengaged from each other. In the circuit board connector device, even in a case where the first connector and the second connector in an engageable connection state are disengaged not linearly but in an inclined state, engagement portions of the first connector and the second connect separated as linearly as possible. With this configuration, a load on these engagement portions and terminals arranged at the engagement portions can be reduced, and damage of the engagement portions and the terminals can be reduced.

In the circuit board connector device of the above-described aspect, the first length direction may be longer than the first width direction, and the second length direction may be longer than the second width direction.

Moreover, in the circuit board connector device of the above-described aspect, at least part of the projecting portion may be positioned between the connection portion and the collision surface in the engagement direction in disengagement between the first connector and the second connector.

Further, in the circuit board connector device of the above-described aspect, at least part of the projecting portion may be a portion positioned on the outermost side of an engagement-side surface of the projecting portion in the first width direction.

In addition, in the circuit board connector device of the above-described aspect, in the engagement direction, the engagement-side surface of the projecting portion and a surface of the second receiving portion opposite to the engagement side may be at the same position.

Moreover, in the circuit board connector device of the above-described aspect, in the engagement direction, the collision surface and an engagement-side top surface of the protruding wall may be at the same position.

Further, in the circuit board connector device of the above-described aspect, in the engagement direction, the collision surface and the top portion of the raised curved portion may be at the same position.

In addition, in the circuit board connector device of the above-described aspect, in the engagement direction, the engagement-side top surface of the protruding wall and the top portion of the raised curved portion may be at the same position.

Moreover, in the circuit board connector device of the above-described aspect, each first terminal may be formed in a substantially recessed shape corresponding to the first receiving portion in a plane along the engagement direction and the first width direction, and when the second peripheral wall is fitted in the first receiving portion, the second peripheral wall may be fitted in the substantially-recessed first receiving portion.

Further, in the circuit board connector device of the above-described aspect, each first terminal may include an outer arm portion continuous to the raised curved portion along the engagement direction on the outside of the top portion of the raised curved portion in the first width direction, and the outer arm portion may be embedded and held in the first housing.

In addition, in the circuit board connector device of the above-described aspect, part of the raised curved portion positioned outside the top portion of the raised curved portion in the first width direction may be provided in a state exposed to an outside. In the array area of the first terminals included in the primary first terminal group and the array area of the first terminals included in the secondary first terminal group, the first housing may form the same surface as a surface of the part of the raised curved portion provided in the state exposed to the outside.

Moreover, in the circuit board connector device of the above-described aspect, the total of four collision surfaces separated from each other in the first length direction and the first width direction may be provided.

The circuit board connector device of the above-described aspect includes the first and second connectors engageably connected to or disengaged from each other. In the circuit board connector device, even in a case where the first connector and the second connector in the engageable connection state are disengaged not linearly but in the inclined state, the engagement portions of the first connector and the second connector are separated as linearly as possible. With this configuration, the load on these engagement portions and the terminals arranged at the engagement portions can be reduced. As a result, damage of the engagement portions and the terminals can be reduced.

Figure 2:
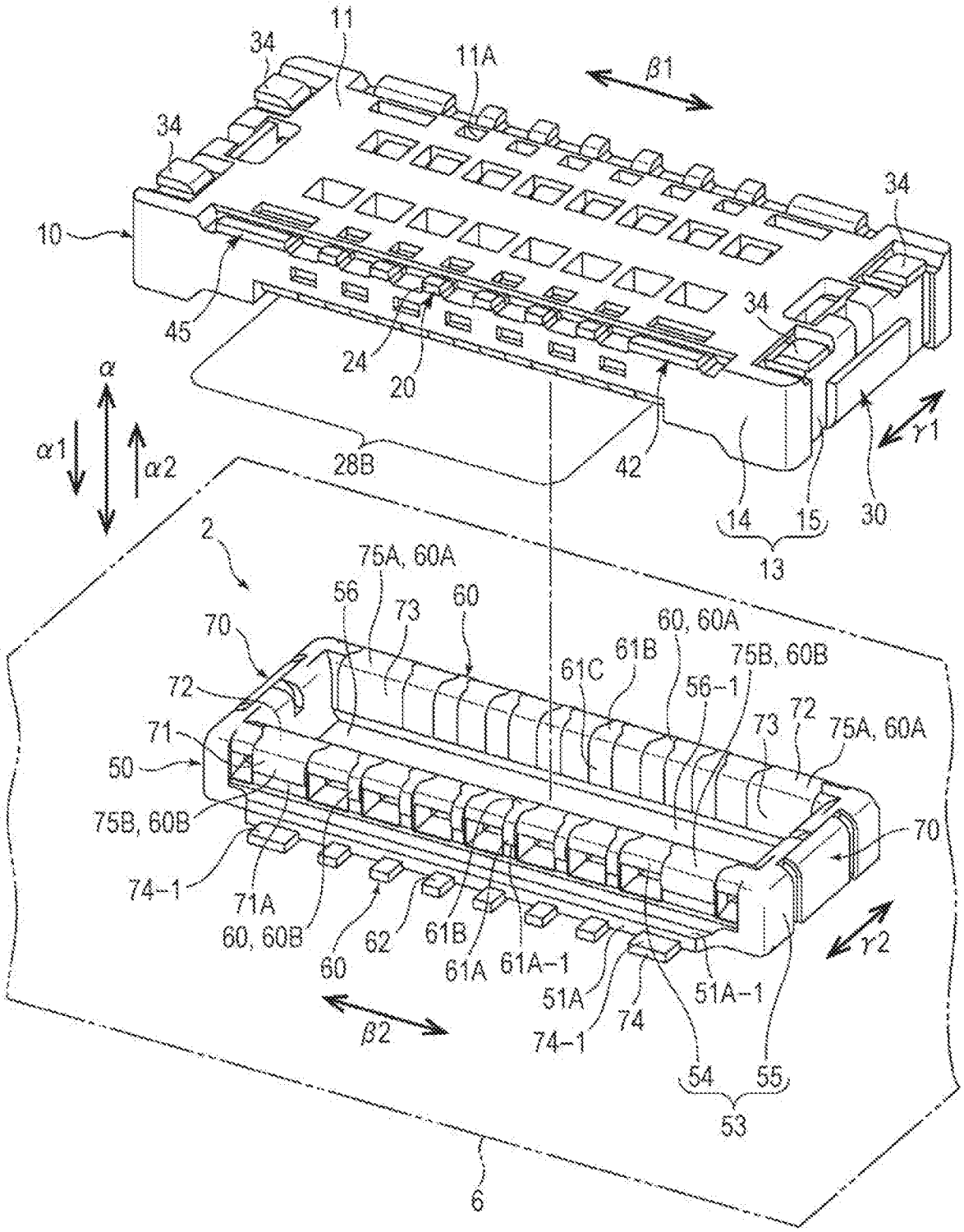
FIG. 2 is a perspective view illustrating the receptacle connector and the plug connector of FIG. 1 in a vertically-flipped state.
Figure 3:
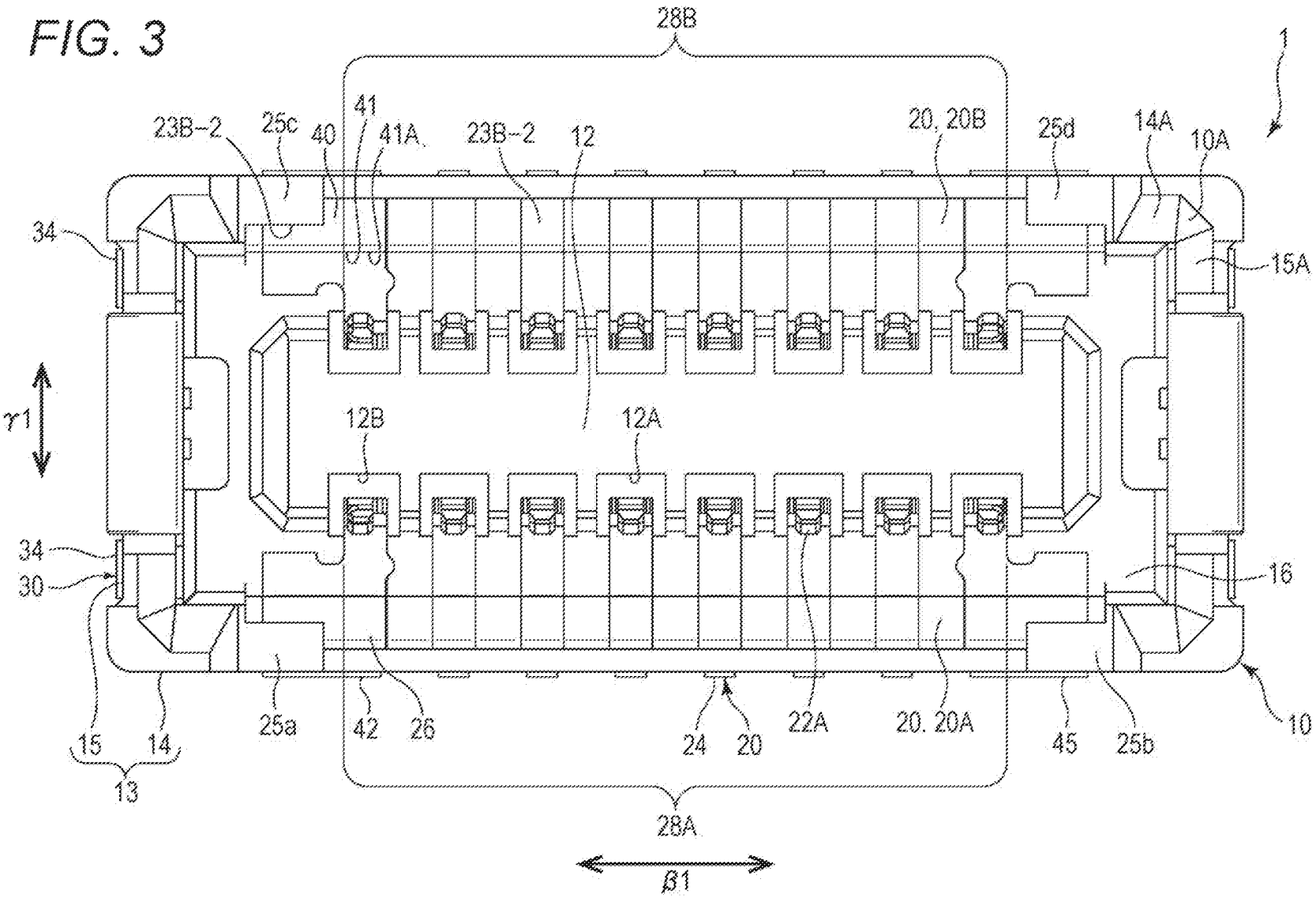
FIG. 3 is a plan view of the receptacle connector.

Hereinafter, one preferable embodiment of the present disclosure will be described with reference to the attached drawings. FIG. 1 is a perspective view of a receptacle connector (a first connector) 1 and a plug connector (a second connector) 2 as a partner connector to be engageably connected to or disengaged from the receptacle connector 1, in a circuit board connector device according to the present embodiment. FIG. 1 illustrates a state before engageable connection of the receptacle connector 1 and the plug connector 2 or after disengagement of the receptacle connector 1 and the plug connector 2. FIG. 2 is a perspective view illustrating the receptacle connector 1 and the plug connector 2 of FIG. 1 in a vertically-flipped state. Further, FIG. 3 is a plan view of the receptacle connector 1.

The receptacle connector 1 in the present embodiment is a circuit board electric connector arranged on a mounting surface of a circuit board 5. The plug connector 2 is a circuit board electric connector arranged on a mounting surface of a circuit board 6 different from the circuit board 5. FIG. 1 illustrates the circuit board 5 of the receptacle connector 1. FIG. 2 illustrates the circuit board 6 of the plug connector 2. The receptacle connector 1 and the plug connector 2 form a connector assembly. In this connector assembly, a direction at a right angle to the mounting surfaces of the circuit boards 5, 6 is an original, i.e., ideal, engagement direction "α."

For the sake of convenience, in the present specification, a direction in which the plug connector 2 is engageably connected to the receptacle connector 1 will be referred to as an engageable connection direction "α1." On the other hand, a direction in which the plug connector 2 is disengaged from the receptacle connector 1 will be referred to as a disengagement direction "α2." Further, a direction along the engageable connection direction "α1" and the disengagement direction "α2" will be referred to as the engagement direction "α." In addition, for the sake of convenience, a side on which the receptacle connector 1 is positioned in the engagement direction "α" will be referred to as a "lower" side, and on the other hand, a side on which the plug connector 2 is positioned in the engagement direction "α" will be referred to as an "upper" side. These sides will be distinguished from each other. Note that these terms of "upper" and "lower" are phrases for distinguishing the directions, and do not have significant meanings.

[Configuration of Receptacle Connector 1]

The receptacle connector 1 is arranged and mounted on the circuit board 5 in a posture illustrated in FIGS. 1 and 2, The receptacle connector 1 is in a substantially rectangular parallelepiped outer shape. The receptacle connector 1 has a first housing 10, multiple receptacle signal terminals 20, receptacle supply terminals 45A, 45B, and receptacle reinforcing fittings 30.

The first housing 10 has a portion along the engagement direction "α," a portion along a length direction "β1" (a first length direction) perpendicular to the engagement direction "α," and a portion along a width direction "γ1" (a first width direction) perpendicular to the engagement direction "α." The multiple receptacle signal terminals 20 and the receptacle supply terminals 45A, 45B are, along the length direction "β1," arrayed and held on the first housing 10 by integral molding. The receptacle reinforcing fittings 30 are held on the first housing 10 by integral molding.

The receptacle signal terminals 20 form two lines symmetrical in the width direction "γ1." Moreover, the multiple (six in this case) receptacle signal terminals 20 are arrayed along the length direction "β1." Further, the receptacle supply terminals 45 form two lines symmetrical in the width direction "γ1." In addition, the receptacle supply terminals 45 include the total of two receptacle supply terminals 45A, 45B arrayed on the outside of the receptacle signal terminal 20 along the length direction "β1." The receptacle reinforcing fittings 30 are, one by one, arranged at end portions of the first housing 10 facing each other in the length direction "β1" in a state in which the receptacle reinforcing fittings 30 are soldered to the circuit board 5 by means of fixing portions 34 etc. The size of the first housing 10 may be small. For example, the dimension of the first housing 10 in the length direction "β1" may be about 3 to 10 mm. Moreover, the dimension of the first housing 10 in the width direction "β1" may be about 1 to 5 mm. In this case, the length direction "β1" is a long-side direction of the first housing 10. Moreover, the width direction "β1" is a short-side direction of the first housing 10. Further, the length direction "β1" and the width direction "γ1" are perpendicular to each other. On this point, the length direction "β1" may be the short-side direction, and the width direction "γ1" may be the long-side direction. In addition, the length direction "β1" and the width direction "γ1" are not necessarily perpendicular to each other.

The first housing 10 is made of an electric insulating material such as resin. The first housing 10 has a bottom wall 11 (see FIG. 2), a protruding wall 12, and a rectangular frame-shaped first peripheral wall 13. The bottom wall 11 has a bottom surface parallel to the mounting surface of the circuit board 5 as an attachment target surface, and extends with the length direction "β1" being the long-side direction. The protruding wall 12 stands, at a center region of the bottom wall 11 in the width direction "γ1," upward from the bottom wall 11 to the side of engagement between the receptacle connector 1 and the plug connector 2. Moreover, the protruding wall 12 extends along the length direction "β1." The rectangular frame-shaped first peripheral wall 13 stands upward from the bottom wall 11. Moreover, the first peripheral wall 13 surrounds the outer periphery of the protruding wall 12 in the length direction "β1" and the width direction "γ1."

The first peripheral wall 13 has side walls 14 as a pair of outer walls and end walls 15 as a pair of outer walls. The side walls 14 stand upward from edge portions of the bottom wall 11 facing each other in the width direction "γ1," and extend in the length direction "β1." The end walls 15 stand upward from edge portions of the bottom wall 11 facing each other along the length direction "β1," and couple end portions of the pair of side walls 14. Moreover, the end walls 15 extend in the width direction "γ1."

At the first peripheral wall 13, specifically on an engagement side of the side walls 14, the total of four collision surfaces 25*a* to 25*d* are provided separated from each other in the length direction "β1" and the width direction "γ1." The collision surfaces 25*a* to 25*d* collide with part of the plug connector 2 at least upon disengagement of the receptacle connector 1 and the plug connector 2. A rectangular annular space opening between the first peripheral wall 13 and the protruding wall 12 forms a first receiving portion 16 configured to receive part (53) of the plug connector 2. The first receiving portion 16 is positioned between the first peripheral wall 13 and the protruding wall 12 in the length direction "β1" and the width direction "γ1." The first receiving portion 16 is, in the engagement direction "α," provided recessed to a side opposite to the side of engagement between the receptacle connector 1 and the plug connector 2.

The first housing 10 is formed such that the end portions in the length direction "β1" are higher than the receptacle signal terminals 20, the receptacle supply terminals 45, the receptacle reinforcing fittings 30, and the collision surfaces 25*a* to 25*d*. At each of these end portions, a lateral guide surface 14A is formed at an upper portion of an inner surface (a surface positioned on a first receiving portion 16 side) of the side wall 14. The lateral guide surface 14A is inclined inward in the width direction "γ1" toward the lower side. In a connector engagement process, the lateral guide surface 14A guides, in the width direction "γ1," the plug connector 2 toward the inside of the first receiving portion 16.

An end guide surface 15A is formed at an upper portion of an inner surface (a surface positioned on the first receiving portion 16 side) of each end wall 15. In each end region in the width direction "γ1," the end guide surface 15A is inclined inward in the length direction "β1" toward the lower side. Upper and lower edges of the end guide surface 15A are positioned at the same heights as those of upper and lower edges of the lateral guide surface 14A. In the connector engagement process, the end guide surface 15A guides, along the length direction "β1," the plug connector 2 toward the inside of the first receiving portion 16.

Moreover, a corner guide surface 10A is formed between the lateral guide surface 14A and the end guide surface 15A. The corner guide surface 10A is inclined inward in the width direction "γ1" and inward in the length direction "β1" toward the lower side. Upper and lower edges of the corner guide surface 10A are positioned at the same heights as those of the upper and lower edges of the lateral guide surface 14A and the end guide surface 15A. In the connector engagement process, the corner guide surface 10A guides, along the width direction "γ1" and the length direction "β1," the plug connector 2 toward the inside of the first receiving portion 16.

The receptacle signal terminals 20 form, together with the receptacle supply terminals 45A, 45B, a primary first terminal group 20A and a secondary first terminal group 20B as two terminal groups. The primary first terminal group 20A and the secondary first terminal group 20B form two lines symmetrical in the width direction "γ1." in the later-described area of the protruding wall 12 of the first housing 10 in the length direction "β1." The primary first terminal group 20A and the secondary first terminal group 20B are arrayed along the length direction "β1," and are arranged facing each other in the width direction "γ1" with the protruding wall 12 of the first housing 10 being interposed therebetween.

The collision surfaces 25*a* to 25*d* provided at the first peripheral wall 13 are provided only in an outer region in the length direction "β1" with respect to an array area 28A of the receptacle signal terminals 20 and the receptacle supply terminal 45A included in the primary first terminal group 20A and an outer region in the length direction "β1" with respect to an array area 28B of the receptacle signal terminals 20 (more specifically, contact arm portions 22 thereof) and the receptacle supply terminal 45B (more specifically, a contact arm portion 44 thereof) included in the secondary first terminal group 20B. In other words, no collision surfaces 25*a* to 25*d* are provided in the array area 28A of the receptacle signal terminals 20 included in the primary first terminal group 20A and the array area 28B of the receptacle signal terminals 20 included in the secondary first terminal group 20B. As a result, these areas are recessed inward in the width direction "γ1" with respect to portions provided with the collision surfaces 25*a* to 25*d*.

At positions of the protruding wall 12 corresponding to the receptacle signal terminals 20 in the length direction "β1," signal terminal groove portions 12A are recessed from a side surface of the protruding wall 12 at a right angle to the width direction "γ1," and are formed to extend in the engagement direction "α." Moreover, at positions corresponding to the receptacle supply terminals 45, supply terminal groove portions 12B are recessed from the side surface of the protruding wall 12 at a right angle to the width direction "γ1," and are formed to extend in the engagement direction "α." The terminal groove portions 12A, 12B are formed across the substantially entirety of an area where the protruding wall 12 stands. The terminal groove portions 12A, 12B open at upper end positions thereof. Further, at lower end positions, at least some of the terminal groove portions 12A, 12B are closed by the bottom wall 11. The terminal groove portions 12A, 12B house the contact arm portions 22, 44 of the terminals 20, 45.

Note that regarding the receptacle reinforcing fitting 30 and the receptacle supply terminal 45, the receptacle supply terminal 45 may be formed as part of the receptacle reinforcing fitting 30, or may be formed as a member separated from the receptacle reinforcing fining 30.

Figure 4:
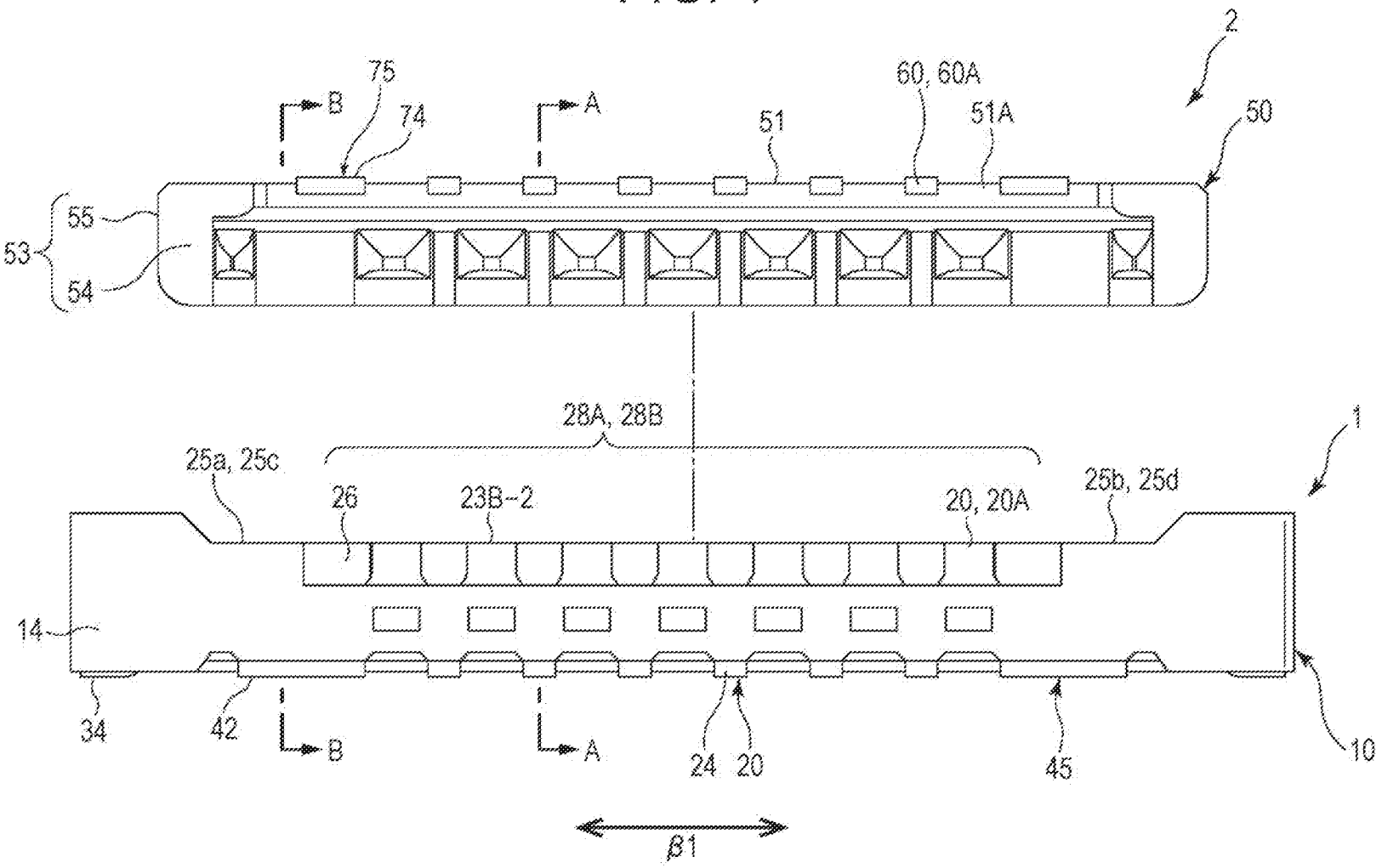
FIG. 4 is a side view of a state before engageable connection of the receptacle connector and the plug connector or after disengagement of the receptacle connector and the plug connector.
Figure 5A:
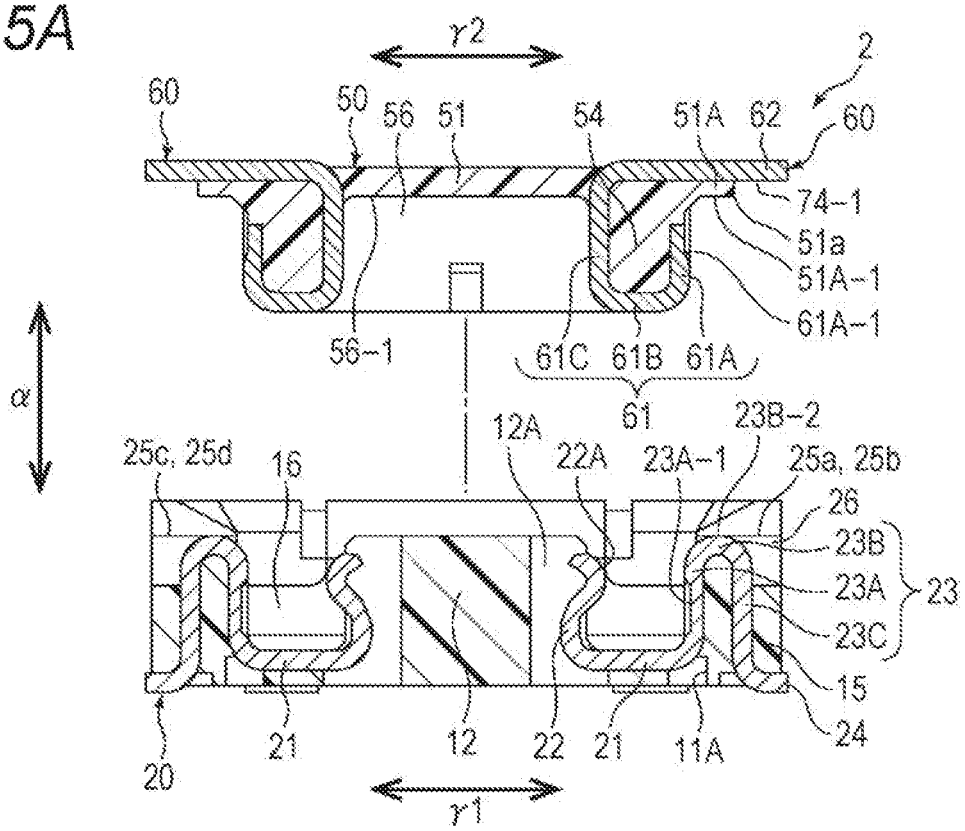
FIGS. 5A and 5B are sectional views along an A-A line and a B-B line of FIG. 4.
Figure 5B:
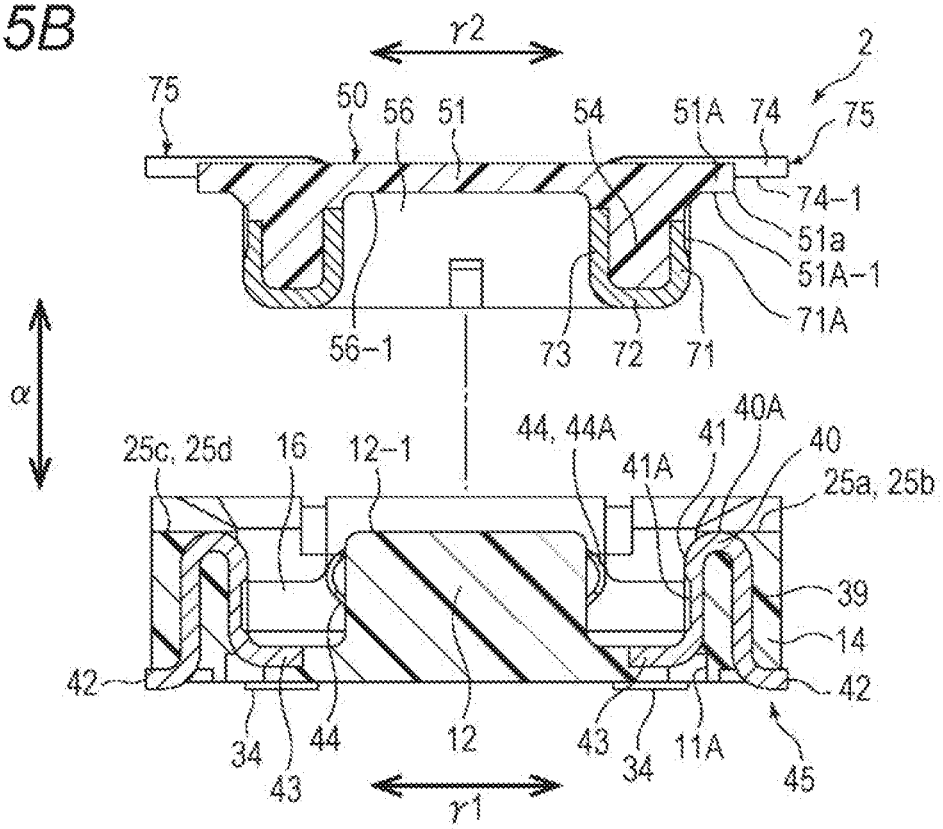

FIG. 4 illustrates a side view of the receptacle connector 1 and the plug connector 2 in the state illustrated in FIGS. 1 and 2. FIG. 5A illustrates a sectional view along an A-A line of FIG. 4. FIG. 5B illustrates a sectional view along a B-B line of FIG. 4.

As clearly illustrated in FIG. 5A, the receptacle signal terminals 20 are formed in such a manner that strip-shaped metal plate pieces are bent in a plate thickness direction. The receptacle signal terminal 20 has a base portion 21 extending in a width direction "γ2" along the bottom wall 11 of the housing, the contact arm portion 22 extending upward from an end portion of the base portion 21 on a protruding wall 12 side, an inverted U-shaped holding target portion 23 folded back downward at an end portion of the base portion 21 on a side wall 14 side after having extended upward, and a connection portion 24 extending outward in the width direction "γ2" from a lower end of the holding target portion 23. The base portion 21, the contact arm portion 22, and the holding target portion 23 are formed in a substantially recessed shape corresponding to the first receiving portion 16 in a (parallel) plane along the engagement direction "α" and the width direction "γ1." At positions of the bottom wall 11 corresponding to the receptacle signal terminals 20 in the length direction "β1," multiple bottom hole portions 11A penetrating the bottom wall 11 in the engagement direction "α" are arrayed and formed along the length direction "β1." Such a bottom hole portion 11A is, in the width direction "γ1," formed between the contact arm portion 22 and the holding target portion 23 of the receptacle signal terminal 20.

The base portion 21 is held on the bottom wall 11 by integral molding. An upper surface of the base portion 21 is exposed to the inside of the first receiving portion 16. Further, part of a lower surface of the base portion 21 is exposed to a circuit board side.

The contact arm portion 22 is housed in the signal terminal groove portion 12A of the protruding wall 12, and is elastically displaceable in a plate thickness direction thereof (the width direction "γ1"). An upper end portion of the contact arm portion 22 as a free end side curves in a raised shape toward the side wall 14. Thus, the upper end portion of the contact arm portion 22 functions as an elastic protruding portion 22A configured to elastically contact a later-described plug signal terminal 60 of the plug connector 2. For favorable contact with the plug signal terminal 60, the elastic protruding portion 22A is provided in a shape elastically protruding outward of the protruding wall 12 in the width direction "γ1." The contact arm portion 22 is positioned inside the first receiving portion 16 such that a curved top portion of the elastic protruding portion 22A protrudes from the signal terminal groove portion 12A of the first housing 10 in a free state.

The holding target portion 23 has, from the end portion of the base portion 21 on the side wall 14 side along the inner surface of the side wall 14 in the engagement direction "α," an inner arm portion 23A extending upward, a transition portion 23B, and an outer arm portion 23C. The holding target portion 23 is held on the side wall 14 by integral molding. The transition portion 23B is continuous from an upper end of the inner arm portion 23A, and is folded back downward at a position outside the inner arm portion 23A in the width direction "γ1." The outer arm portion 23C is continuous from the transition portion 23B, and extends downward along the engagement direction "α" at a position outside the transition portion 23B in the width direction "γ1."

At the inner arm portion 23A, a plate surface is exposed to the inside of the first receiving portion 16. A lock recessed portion 23A-1 recessed in a rectangular shape from the plate surface is formed at the inner arm portion 23A. The lock recessed portion 23A-1 is locked with a later-described lock target step portion 61A-1 of the plug signal terminal 60 of the plug connector 2. Thus, the lock recessed portion 23A-1 maintains a connector engagement state, and reduces connector detachment. Further, the lock recessed portion 23A-1 contacts the lock target step portion 61A-1 to be in electric conduction with the lock target step portion 61A-1 upon locking with the lock target step portion 61A-1. Thus, the lock recessed portion 23A-1 also fulfills a role in assisting the elastic protruding portion 22A.

The transition portion 23B curves in an upwardly-raised shape, and therefore, forms a raised curved portion. The substantially entirety of the raised curved portion (the transition portion 23B) including inner and outer portions in the width direction "γ1" with respect to a top portion 23B-2 of the raised curved portion protruding most to the engagement side is exposed through the first housing 10 (the side wall 14). The outer arm portion 23C is not exposed through the side wall 14, but is embedded and held in the side wall 14 (also see FIG. 5B).

The connection portion 24 outwardly extends, at a position below the base portion 21, straight from a lower end of the outer arm portion 23C to the substantially same position as that of an outer surface of the side wall 14 in the width direction "γ1." The connection portion 24 is exposed through the bottom wall 11 of the first housing 10. The connection portion 24 is soldered to a corresponding signal circuit portion (not shown) of the circuit board 5.

The above-described collision surfaces 25*a* to 25*d* are provided in a state in which the collision surfaces 25*a* to 25*d* project outward in the width direction "γ1" with respect to the top portion 23B-2 of the raised curved portion 23B (the transition portion 23B) protruding most to the engagement side in the raised curved portion forming the transition portion 23B and extend along the length direction "β1." That is, the collision surfaces 25*a* to 25*d* are (parallel) surfaces along the length direction "β1" and the width direction "γ1" perpendicular to the engagement direction "α." Moreover, these collision surfaces 25*a* to 25*d* are, in the engagement direction "α," at the same positions as that of the top portion 23B-2 of the raised curved portion 23B and the same position as that of an engagement-side top surface 124 of the protruding wall 12. Further, the engagement-side top surface 12-1 of the protruding wall 12 is, in the engagement direction "α," at the same position as that of the top portion 23B-2 of the raised curved portion 23B.

As clearly illustrated in FIG. 5B, the receptacle supply terminal 45 has the substantially same sectional shape as that of the receptacle signal terminal 20. The receptacle supply terminal 45 has, as members corresponding to the base portion 21, the contact arm portion 22, the holding target portion 23, and the connection portion 24 of the receptacle signal terminal 20, a base portion 43, the contact arm portion 44, a holding target portion 39, and a connection portion 42. An elastic protruding portion 44A corresponding to the elastic protruding portion 22A of the receptacle signal terminal 20 is formed at the contact arm portion 44. Moreover, a lock recessed portion 41A corresponding to the lock recessed portion 23A-1 of the receptacle signal terminal 20 and recessed in a rectangular shape is formed at a lock plate portion 41 of the side-wall-side holding target portion 39.

As in the transition portion 23B of the holding target portion 23 of the receptacle signal terminal 20, a transition portion 40 of the holding target portion 39 upwardly curves in a raised shape. A top portion 40A of the transition portion 40 is, in the engagement direction "α," at the same position as those of the top portion 23B-2 of the transition portion 23B and an upper surface of the side wall 14.

The receptacle connector 1 having the above-described configuration is manufactured in the following manner. First, the receptacle signal terminals 20, the receptacle supply terminals 45, and the receptacle reinforcing fittings 30 are fixed by an upper mold provided from above and a lower mold provided from below. In this state, the receptacle signal terminals 20 and the receptacle supply terminals 45 are specifically as follows. That is, as a result of providing a recess 26 recessed inward in the width direction "γ1," the entirety of each transition portion 23B can be pressed. Thus, a pressing area is larger as compared to the case of pressing only the half of the transition portion 23B, more specifically the case of pressing only the inner portion of the raised curved portion forming the transition portion 23B in the width direction "γ1" with respect to the top portion 23B-2 of the raised curved portion protruding most to the engagement side. Thus, the posture of the receptacle signal terminal 20 in integral molding can be more stabilized. Note that such a recess 26 exposes, to the outside, part of the raised curved portion 23B positioned outside in the width direction "γ1" with respect to the top portion 23B-2 of the raised curved portion 23B of the receptacle signal terminal 20. Moreover, the first housing 10 positioned in such a recess 26 forms, in the array areas 28A, 28B, the same surface as a surface of part of the raised curved portion 23B exposed to the outside.

Next, resin is injected into two upper and lower molds combined together to integrally mold the receptacle signal terminals 20, the receptacle supply terminals 45, and the receptacle reinforcing fittings 30 together with the first housing 10. In this manner, the receptacle signal terminals 20, the receptacle supply terminals 45, and the receptacle reinforcing fittings 30 are held by the first housing 10.

Thereafter, the upper mold and the lower mold are each moved to the upper and lower sides, and are removed. In this manner, the receptacle connector 1 is brought to completion.

[Configuration of Plug Connector 2]

Next, a configuration of the plug connector 2 will be described. The plug connector 2 is arranged and mounted on the circuit board 6 in the posture illustrated in FIGS. 1 and 2. As seen from FIGS. 1 and 2, the plug connector 2 is in a substantially rectangular parallelepiped shape. The plug connector 2 has a second housing 50, the multiple plug signal terminals 60, plug supply terminals 75A, 75B, and plug reinforcing fittings 70. The second housing 50 has a portion along the engagement direction "α," a portion along a length direction "β2" (a second length direction) perpendicular to the engagement direction "α," and a portion along the width direction "γ2" (a second width direction) perpendicular to the engagement direction "α." The multiple plug signal terminals 60 and the plug supply terminals 75A, 75B are arrayed and held on the second housing 50 by integral molding along the length direction "β2."

The plug signal terminals 60 form two lines symmetrical in the width direction "γ2." Moreover, the multiple (six in this case) plug signal terminals 60 are arrayed along the length direction "β2." Moreover, the plug supply terminals 75 form two lines symmetrical in the width direction "γ2." Further, the plug supply terminals 75 include the total of two plug supply terminals 75A, 75B arrayed on the outside of the plug signal terminal 60 along the length direction "β2." The plug reinforcing fittings 70 are, one by one, arranged at end portions of the second housing 50 facing each other in the length direction "β2."

Note that in this case, the length direction "β2" is a long-side direction of the second housing 50, and the width direction "β2" is a short-side direction of the second housing 50. Moreover, the length direction "β2" and the width direction "γ2" are perpendicular to each other. However, the length direction "β2" may be the short-side direction, and the width direction "γ2" may be the long-side direction. Moreover, the length direction "β2" and the width direction "γ2" are not necessarily perpendicular to each other.

The second housing 50 is made of an electric insulating material such as resin. The second housing 50 has a bottom wall 51, a second peripheral wall 53, and a second receiving portion 56. The bottom wall 51 has a bottom surface parallel to the mounting surface of the circuit board 6 as an attachment target surface, and extends in the length direction "β2." The second peripheral wall 53 stands downward from the bottom wall 51 to the side of engagement between the receptacle connector 1 and the plug connector 2. Moreover, the second peripheral wall 53 has a rectangular frame shape as an engagement portion arranged in an annular shape in the length direction "β2" and the width direction "γ2." The second receiving portion 56 is recessed to the side opposite to the engagement side in the engagement direction "α."

Further, the second receiving portion 56 is formed inside the second peripheral wall 53 in the length direction "β2" and the width direction "γ2."

The second peripheral wall 53 has two side walls 54 facing each other and extending in the length direction "β2," and two end walls 55. These two end walls 55 couple end portions of two side walls 54, and extend in the width direction "γ2" at a right angle to the connector length direction. A space surrounded by the second peripheral wall 53 and opening on the engagement side forms the second receiving portion 56 configured to receive the protruding wall 12 of the receptacle connector 1.

Projecting portions 51A are formed at the bottom wall 51, i.e., on the side opposite to an engagement side of the second peripheral wall 53. The projecting portion 51A extends across the entirety of the side wall 54 in the width direction "γ2." Moreover, the projecting portion 51A is formed in a state in which the projecting portion 51A projects outward of the side wall 54 in the width direction "γ2." The projecting portion 51A is, in the width direction "γ2," positioned corresponding to the transition portion 23B of the receptacle signal terminal 20 and the transition portion 40 of the receptacle supply terminal 45. An engagement-side surface 51A-1 of the projecting portion 51A is arranged at a position higher than both of a later-described connection portion 62 of the plug signal terminal 60 and an upper surface 74-1 of a lateral fixing portion (a connection portion) 74 of the plug supply terminal 75. Moreover, the engagement-side surface 51A-1 of the projecting portion 51A and a surface 56-1 of the second receiving portion 56 opposite to the engagement side are at the same position in the engagement direction "α."

The plug signal terminals 60 form, together with the plug supply terminals 75A, 75B, two terminal groups (a primary second terminal group 60A and a secondary second terminal group 60B). These terminal groups 60A, 60B form two lines symmetrical in the width direction "γ2" in the later-described area of the second receiving portion 56 of the second housing 50 in the length direction "β2." Moreover, each of the terminal groups 60A, 60B is arrayed along the length direction "β2." Further, the terminal groups 60A, 60B are arranged facing each other with the later-described second receiving portion 56 of the second housing 50 being interposed therebetween in the width direction "γ2."

As clearly illustrated in FIG. 5A, the plug signal terminals 60 are formed in such a manner that strip-shaped metal plate pieces are bent in a plate thickness direction. The plug signal terminal 60 has a U-shaped portion 61 held on the side wall 54, and the connection portion 62. The connection portion 62 extends outward in the width direction "γ2" from an upper end of one (a later-described inner arm portion 61C) of two arm portions of the U-shaped portion 61 positioned on a second receiving portion 56 side. Moreover, the connection portion 62 is connected to a corresponding signal circuit portion of the circuit board. The plug signal terminal 60 is integrally molded with the second housing 50, and is held on the second housing 50 via the U-shaped portion 61.

The U-shaped portion 61 is a portion entering between the contact arm portion 22 and the inner arm portion 23A of the receptacle signal terminal 20 of the receptacle connector 1 in the connector engagement state. The U-shaped portion 61 is embedded in the side wall 54 to extend over the side wall 54 from below. The U-shaped portion 61 has an outer arm portion 61A extending downward along an outer surface of the side wall 54, a transition portion 61B, and the inner arm portion 61C. The transition portion 61B is, at an inner position in the width direction "γ2," folded back upward from a lower end of the outer arm portion 61A. The inner arm portion 61C extends upward through the transition portion 61B.

A plate surface of the outer arm portion 61A of the U-shaped portion 61 is exposed through the outer surface of the side wall 54. The lock target step portion 61A-1 is formed at such an exposed plate surface. The lock target step portion 61A-1 has a step shape formed in such a manner that an upper portion of the plate surface is recessed. The lock target step portion 61A-1 extends in a width direction (the connector length direction) of the outer arm portion 61A. It is configured such that the lock target step portion 61A-1 is locked with the lock recessed portion 23A-1 of the receptacle signal terminal 20. The transition portion 61B extends in the width direction "γ2." A lower surface of the transition portion 61B is exposed through the side wall 54. A plate surface of the inner arm portion 61C on the second receiving portion 56 side is exposed through an inner surface of the side wall 54. Such an exposed plate surface is formed as a corresponding contact portion. The corresponding contact portion is a portion contacting, with contact pressure, the elastic protruding portion 22A of the receptacle signal terminal 20 in the connector engagement state.

The connection portion 62 extends, in the width direction "γ2," straight from the upper end of the inner arm portion 61C to the outside of the side wall 54 along the bottom surface of the bottom wall 51. The connection portion 62 extends outward of the second housing 50 (also see FIG. 1). The connection portion 62 can be soldered to the corresponding signal circuit portion of the circuit board.

As clearly illustrated in FIG. 5B, the plug supply terminal 75 has the substantially same shape as that of the plug signal terminal 60. As in the plug signal terminal 60, the plug supply terminal 75 is formed in such a manner that a metal plate member is bent in a plate thickness direction. The plug supply terminal 75 has, as members corresponding to the outer arm portion 61A, the transition portion 61B, the inner arm portion 61C, and the connection portion 62 of the plug signal terminal 60, an outer arm portion 71, a transition portion 72, an inner arm portion 73, and the lateral fixing portion (the connection portion) 74. A lock target step portion 71A corresponding to the lock target step portion 61A-1 of the plug signal terminal 60 and recessed in a step shape is formed at the outer arm portion 71. The lock target step portion 71A is formed at the same height position as that of the lock target step portion 61A-1 of the outer arm portion 61A of the plug signal terminal 60. It is configured such that the lock target step portion 71A is locked with the lock recessed portion 41A of the receptacle supply terminal 45 in the state of engagement between the receptacle connector 1 and the plug connector 2.

Figure 6:
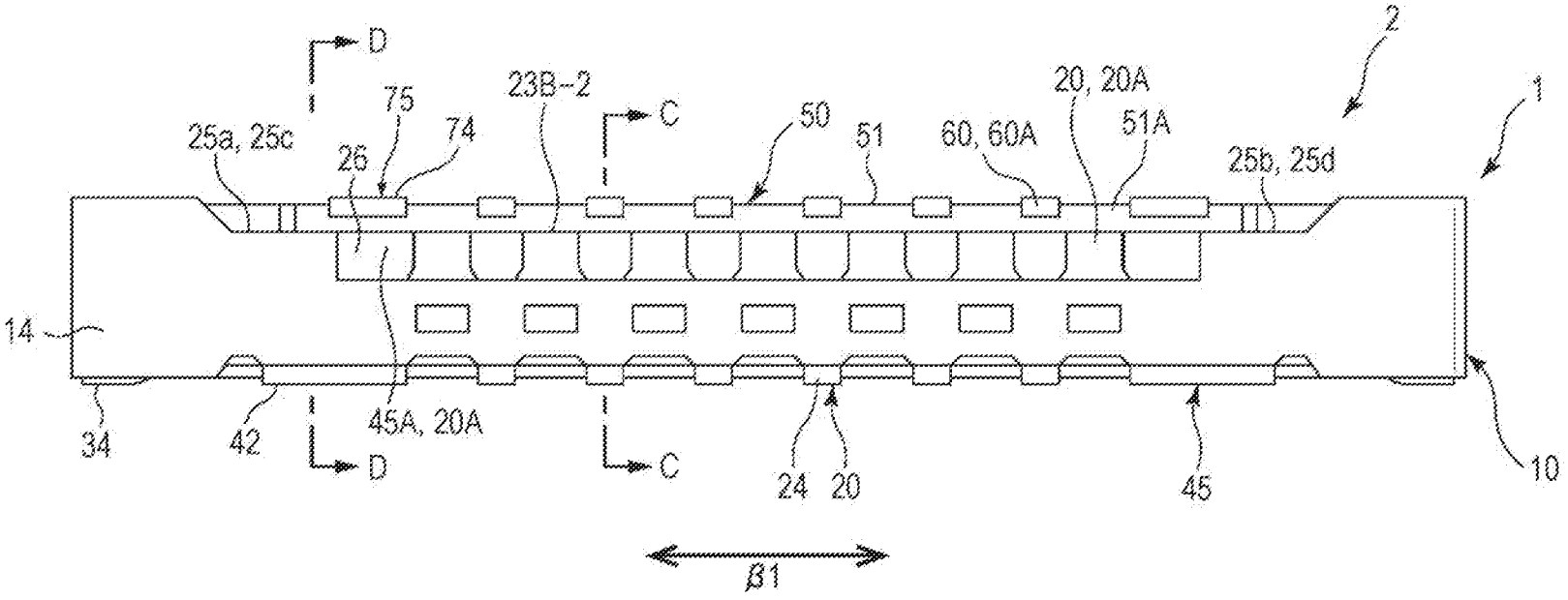
FIG. 6 is a side view of a state after engageable connection of the receptacle connector and the plug connector or before disengagement of the receptacle connector and the plug connector.
Figure 7A:
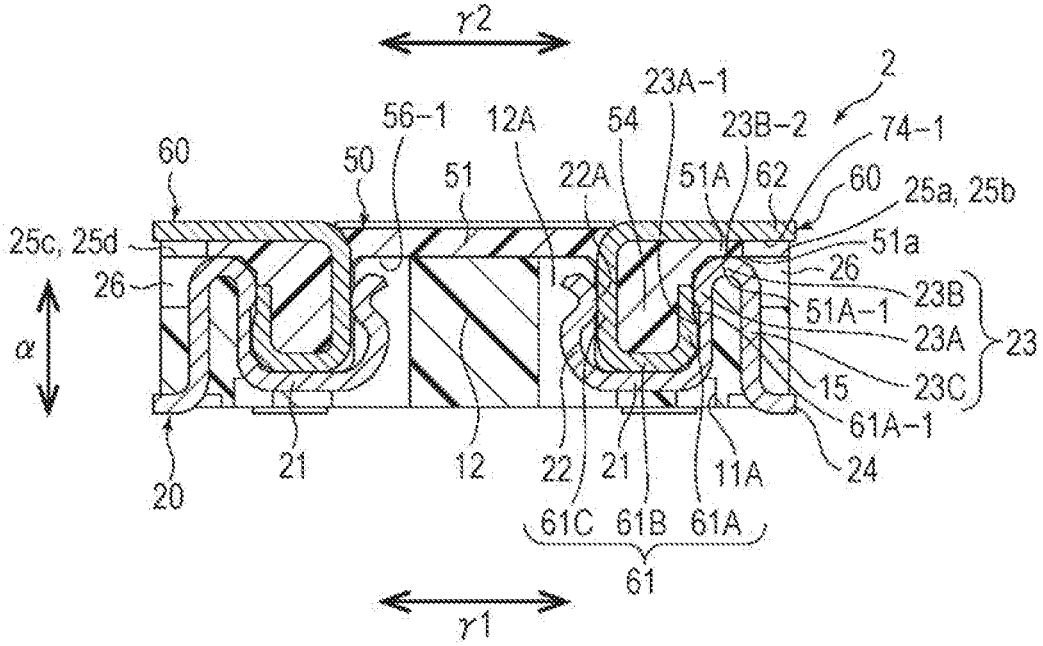
FIGS. 7A and 7B are sectional views along a C-C line and a D-D line of FIG. 6.
Figure 7B:
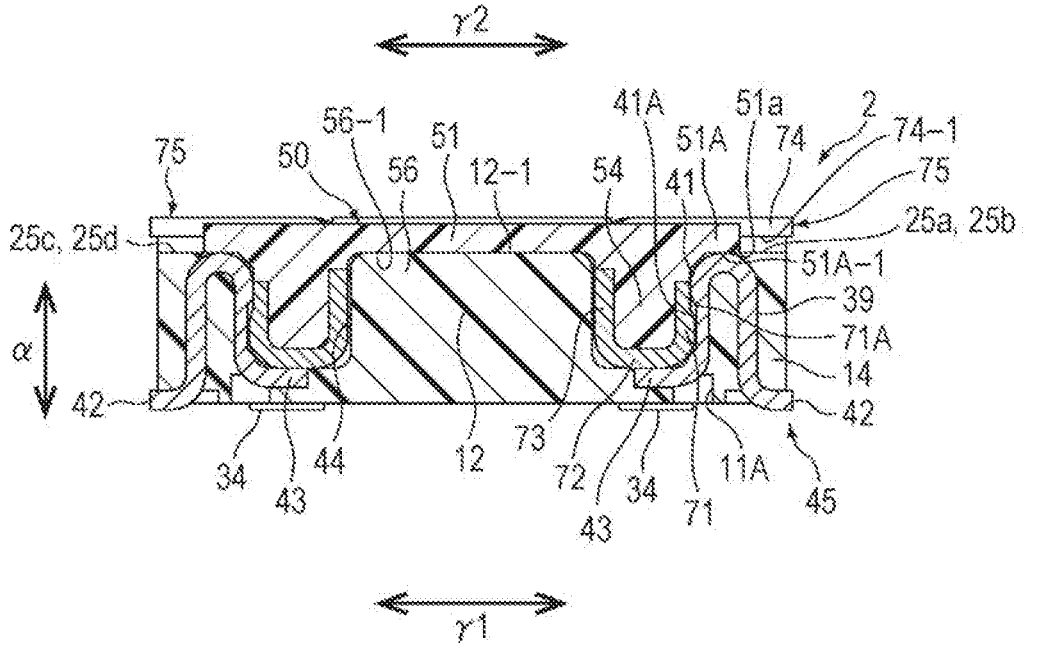

FIG. 6 illustrates a state after engageable connection of the receptacle connector 1 and the plug connector 2 or before disengagement of the receptacle connector 1 and the plug connector 2, i.e., illustrates a side view corresponding to FIG. 4. Moreover, FIG. 7A is a sectional view along a C-C line of FIG. 6, the sectional view corresponding to FIG. 5A. FIG. 7B is a sectional view along a D-D line of FIG. 6, the sectional view corresponding to FIG. 5B.

In engageable connection between the receptacle connector 1 and the plug connector 2, the second peripheral wall 53 of the plug connector 2 is, together with the plug signal terminals 60 etc., fitted in the first receiving portion 16 of the receptacle connector 1. Moreover, the protruding wall 12 of the receptacle connector 1 is, together with some of the receptacle reinforcing fittings 30, fitted in the second receiving portion 56 of the plug connector 2 and part of each receptacle signal terminal 20 having a shape corresponding to the shape of the second receiving portion 56, i.e., a portion formed in a substantially recessed shape by the base portion 21, the contact arm portion 22, and the holding target portion 23.

As a result, the U-shaped portion 61 of each plug signal terminal 60 of the plug connector 2 enters while expanding between the elastic protruding portion 22A and the lock recessed portion 23A-1 of the receptacle signal terminal 20 of the receptacle connector 1. Accordingly, the contact arm portion 22 is elastically displaced inward along the width direction "γ1." When the U-shaped portion 61 further enters, the elastic protruding portion 22A contacts, with the contact pressure, the inner arm portion 61C (the corresponding contact portion) of the U-shaped portion 61 in the connector engagement state. In addition, the lock target step portion 61A-1 of the outer arm portion 61A of the U-shaped portion 61 enters the lock recessed portion 23A-1, and is positioned lockable with an upper edge of the lock recessed portion 23A-1 in a connector detachment direction. As a result, the receptacle signal terminals 20 of the receptacle connector 1 and the plug signal terminals 60 of the plug connector 2 are in electric conduction with each other, and are locked with each other.

Moreover, in engageable connection between the receptacle connector 1 and the plug connector 2, the collision surfaces 25*a* to 25*d* provided at the first housing 10 of the receptacle connector 1 and the projecting portions 51A provided at the second housing 50 of the plug connector 2 come face-to-face with each other in the engagement direction "α."

Figure 8:
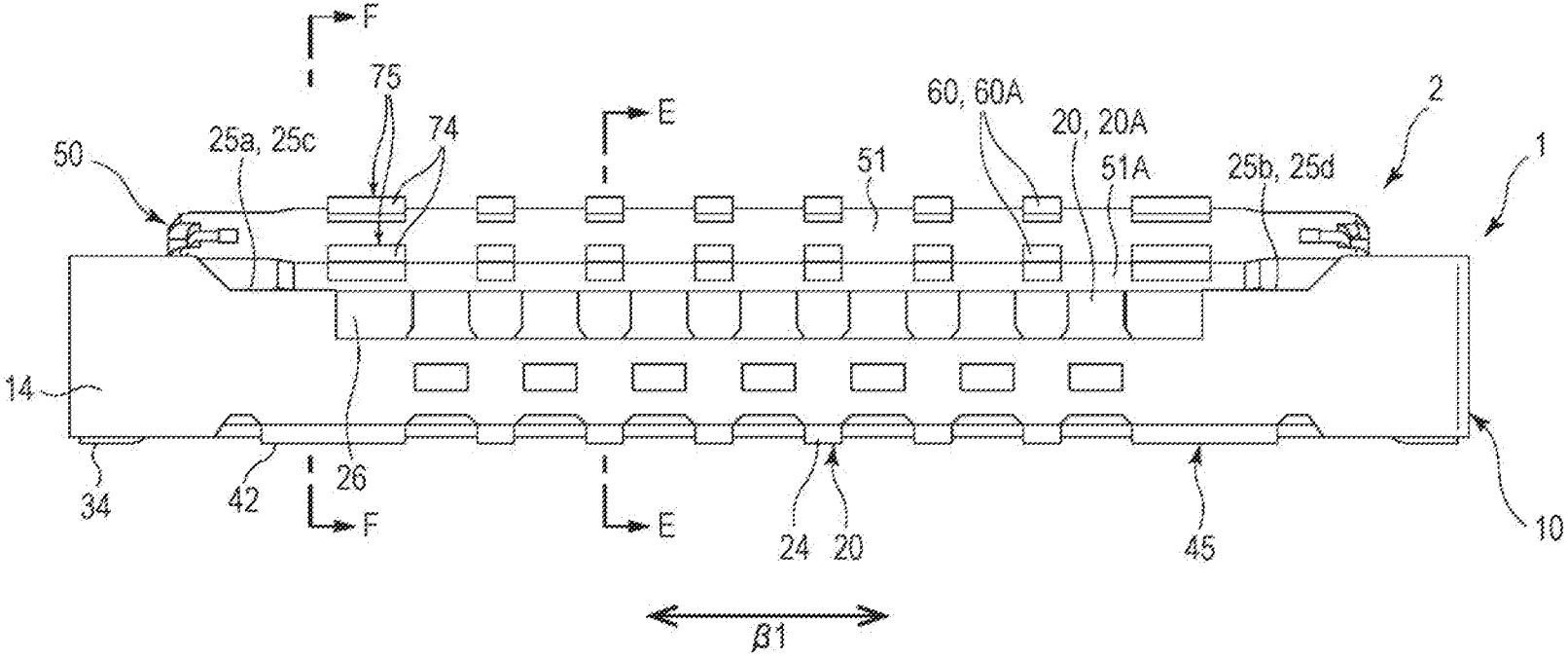
FIG. 8 is a perspective view of a state in disengagement of the receptacle connector and the plug connector.
Figure 9A:
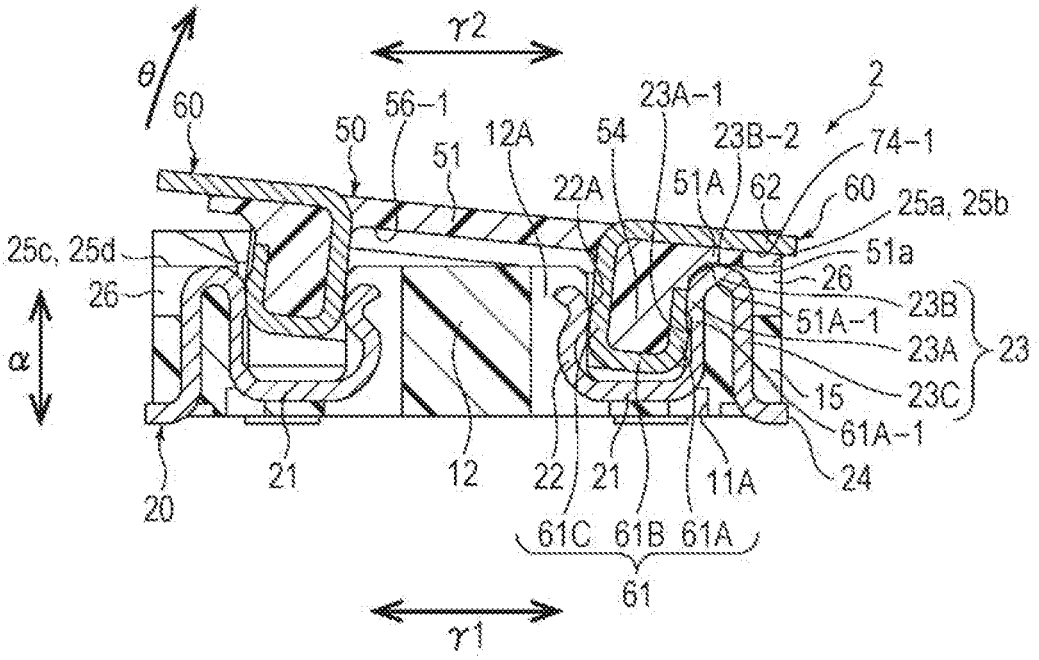
FIGS. 9A and 9B are sectional views along an E-E line and an F-F line of FIG. 8.
Figure 9B:
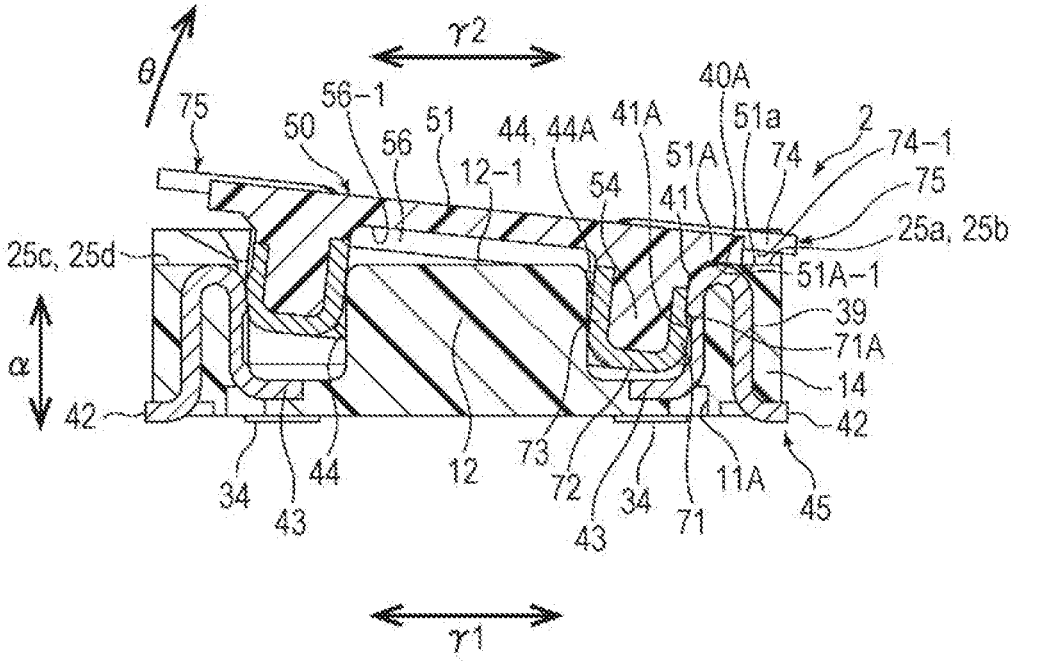

Next, operation of the receptacle connector 1 and the plug connector 2 in disengagement will be described with reference to FIGS. 8, 9A, and 9B. FIG. 8 is a side view corresponding to FIGS. 4 and 6. Moreover, FIG. 9A is a sectional view along an E-E line of FIG. 8, the view corresponding to FIGS. 5A and 7A. FIG. 9B is a sectional view along an F-F line of FIG. 8, the view corresponding to FIGS. 5B and 7B.

When the receptacle connector 1 and the plug connector 2 are disengaged from each other, these connectors are preferably separated from each other linearly. In the configuration of the present embodiment, the recesses 26 are provided on both sides of the plug connector 2 in the width direction "γ2." More specifically, the recesses 26 are each provided in the array area 28A of the receptacle signal terminals 20 included in the primary first terminal group 20A and the array area 28B of the receptacle signal terminals 20 included in the secondary first terminal group 20B.

Thus, in a case where the receptacle connector 1 and the plug connector 2 have, for example, a certain level of size, e.g., a tool is stuck into these recesses 26, so that the receptacle connector 1 and the plug connector 2 in the engagement state can be easily and linearly separated from each other.

In some cases, the plug connector 2 might be rotatably moved in a "θ" direction relative to the receptacle connector 1. Such rotatable movement in the "θ" direction is, for example, caused because the timing of separating one and the other sides of the plug connector 2 in the width direction "γ2" from the receptacle connector 1 is shifted. Alternatively, such rotatable movement in the "θ" direction is caused because a user separates only one of these sides from the receptacle connector 1. Further, such rotatable movement in the "θ" direction is caused because the circuit board 6 is larger than the plug connector 2, it is difficult for the user to visually check the plug connector 2 engageably connected to the receptacle connector 1 due to hiding of the plug connector 2 by the circuit board 6, and the user brings the receptacle connector 1 and the plug connector 2 in an engageable connection state into an inclined state. According to the configuration of the present embodiment, engagement portions of the receptacle connector (the first connector) 1 and the plug connector (the second connector) 2 are separated from each other as linearly as possible as described below. Thus, a load on the terminals arranged at these engagement portions can be reduced. As a result, damage of the engagement portions and the terminals can be reduced.

In the inclined state, at least part of the projecting portion 51A, such as the portion 51*a* of the engagement-side surface 51A-1 of the projecting portion 51A positioned on the outermost side in the width direction "γ1," is positioned between the connection portion 62 of the plug signal terminal 60 and each of the collision surfaces 25*a* to 25*d* in the engagement direction "α." As a result, the collision surfaces 25*a* to 25*d* provided at the first housing 10 of the receptacle connector 1 and part of each projecting portion 51A provided at the second housing 50 of the plug connector 2 collide with each other. For example, in an example of FIG. 9B, part of the projecting portion 51A is specifically the portion 51*a* of the engagement-side surface 51A-1 of the projecting portion 51A positioned on the outermost side in the width direction "γ1." Thus, the plug connector 2 rotatably moves relative to the receptacle connector 1 about such a collision portion by means of the principle of leverage.

As clearly seen, in this case, a greater distance between a spot as the point of effort such as the recess 26 and a portion as a fulcrum point such as the portion 51*a* in the principle of leverage results in greater force acting on the point of load such as the terminal engagement portion. Thus, disengagement can be performed with less force. Moreover, a greater distance between the portion (51*a*) as the fulcrum point and the point of load such as the terminal engagement portion results in greater linear separation of the plug connector 2 from the receptacle connector 1.

Thus, as described in the present embodiment, the collision surfaces 25*a* to 25*d* provided at the first housing 10 of the receptacle connector 1 and part of each projecting portion 51A provided at the second housing 50 of the plug connector 2 collide with each other, and therefore, the following advantageous effects are provided as compared to a case where no collision is made. That is, a load on the engagement portions (12, 16, 53, 56) of the receptacle connector 1 and the plug connector 2 and the terminals (20, 30, 60, 70) arranged at these engagement portions, specifically a load on, e.g., the elastic contact portions (22A, 44A) of the terminals provided to protrude into the engagement portions for elastic contact, can be reduced. As clearly seen, in this case, the portion as the fulcrum point is, as disclosed in the present embodiment, preferably the portion 51*a* of the engagement-side surface 51A-1 of the projecting portion 51A positioned on the outermost side in the width direction "γ1."

Note that in the present embodiment, the elastic protruding portion 22A of the contact arm portion 22 of the receptacle signal terminal 20 protrudes into the first receiving portion 16 in the width direction "γ1." Thus, it is assumed that influence on the terminal is specifically great in the width direction "γ1." In the above-described embodiment, description has been made on the assumption that the plug connector 2 is separated from the receptacle connector 1 in the width direction "γ1." On this point, in a case where the plug connector 2 is rotatable moved in the length direction "β1" relative to the receptacle connector 1, the load on the engagement portions of the receptacle connector 1 and the plug connector 2 and the terminals arranged at the engagement portions can be also reduced by a similar principle, needless to say. This effect is particularly great in a case where some of the terminals are provided as the elastic protruding portions in a protruding state in the engagement portions. Needless to say, preferable advantageous effects can be provided in other cases than the above-described case. Moreover, in the present embodiment, it has been described that the terminals are integrally molded with the housing. However, the terminals are not necessarily integrally molded with the housing, and it is enough to hold the terminals on the housing. For example, the terminals may be press-fitted and fixed to the housing.

What is claimed is:

1. A circuit board connector device comprising:

a first connector and a second connector engageably connected to or disengaged from each other along an engagement direction, wherein the first connector includes a first housing having a portion along the engagement direction, a portion along a first length direction perpendicular to the engagement direction, and a portion along a first width direction, and a primary first terminal group and a secondary first terminal group each having multiple first terminals held on the first housing and arrayed along the first length direction, the second connector includes a second housing having a portion along the engagement direction, a portion along a second length direction perpendicular to the engagement direction, and a portion along a second width direction, and a primary second terminal group and a secondary second terminal group each having multiple second terminals held on the second housing and arrayed along the second length direction, the first housing of the first connector includes a protruding wall standing toward a side of engagement between the first connector and the second connector in the engagement direction and extending along the first length direction, a first peripheral wall standing toward an engagement side in the engagement direction and surrounding an outer periphery of the protruding wall in the first length direction and the first width direction, and a first receiving portion recessed to a side opposite to the engagement side in the engagement direction and positioned between the protruding wall and the first peripheral wall in the first length direction and the first width direction, the primary and secondary first terminal groups of the first connector are each arrayed along the first length direction, and are arranged facing each other with the protruding wall being interposed therebetween in the first width direction, each first terminal includes a first contact portion and a raised curved portion protruding to the engagement side in the engagement direction, the raised curved portion is provided with the raised curved portion being exposed through the first housing, the second housing of the second connector includes a second peripheral wall standing toward the side of engagement between the first connector and the second connector in the engagement direction, arranged in an annular shape in the second length direction and the second width direction, and fitted in the first receiving portion in engageable connection between the first connector and the second connector, and a second receiving portion recessed to the side opposite to the engagement side in the engagement direction, formed inside the second peripheral wall in the second length direction and the second width direction, and configured such that the protruding wall is fitted in the second receiving portion in engageable connection between the first connector and the second connector, the primary and secondary second terminal groups of the second connector are each arrayed along the second length direction, and are arranged facing each other with the second receiving portion being interposed therebetween in the second width direction, each second terminal includes a second contact portion fitted in the first receiving portion in engageable connection between the first connector and the second connector to contact the first contact portion of a corresponding one of the first terminals, and a connection portion protruding outward of the second peripheral wall in the second width direction, a collision surface projecting outward in the first width direction with respect to a top portion of the raised curved portion protruding most to the engagement side and extending along the first length direction is provided on the engagement side of the first peripheral wall, the collision surface is provided in an outer region in the first length direction with respect to an array area of the first terminals included in the primary first terminal group and an outer region in the first length direction with respect to an array area of the first terminals included in the secondary first terminal group, a projecting portion is provided on a side opposite to the engagement side of the second peripheral wall, projects outward in the second width direction with respect to the second peripheral wall, and extends along the second length direction, at least part of the projecting portion collides with the collision surface in disengagement of the first connector and the second connector, the array area comprises a recess, and an outer edge, farthest from the protruding wall in the first width direction, of the collision surface is farther from the protruding wall in the first width direction than an outer edge, farthest from the protruding wall in the first width direction, of a top surface of the array area.

2. The circuit board connector device according to claim 1, wherein the first length direction is longer than the first width direction, and the second length direction is longer than the second width direction.

3. The circuit board connector device according to claim 1, wherein at least part of the projecting portion is positioned between the connection portion and the collision surface in the engagement direction in disengagement of the first connector and the second connector.

4. The circuit board connector device according to claim 1, wherein at least part of the projecting portion is a portion positioned on an outermost side of an engagement-side surface of the projecting portion in the first width direction.

5. The circuit board connector device according to claim 1, wherein an engagement-side surface of the projecting portion and a surface of the second receiving portion opposite to the engagement side are in a same plane perpendicular to the engagement direction.

6. The circuit board connector device according to claim 1, wherein the collision surface and an engagement-side top surface of the protruding wall are in a same plane perpendicular to the engagement direction.

7. The circuit board connector device according to claim 1, wherein the collision surface and the top portion of the raised curved portion are in a same plane perpendicular to the engagement direction.

8. The circuit board connector device according to claim 1, wherein an engagement-side top surface of the protruding wall and the top portion of the raised curved portion are in a same plane perpendicular to the engagement direction.

9. The circuit board connector device according to claim 1, wherein each first terminal is formed in a substantially recessed shape corresponding to the first receiving portion in a plane along the engagement direction and the first width direction, and when the second peripheral wall is fitted in the first receiving portion, the second peripheral wall is fitted in the substantially-recessed first receiving portion.

10. The circuit board connector device according to claim 1, wherein each first terminal includes an outer arm portion continuous to the raised curved portion along the engagement direction on an outside of the top portion of the raised curved portion in the first width direction, and the outer arm portion is embedded and held in the first housing.

11. A circuit board connector device comprising:

a first connector and a second connector engageably connected to or disengaged from each other along an engagement direction, wherein the first connector includes a first housing having a portion along the engagement direction, a portion along a first length direction perpendicular to the engagement direction, and a portion along a first width direction, and a primary first terminal group and a secondary first terminal group each having multiple first terminals held on the first housing and arrayed along the first length direction, the second connector includes a second housing having a portion along the engagement direction, a portion along a second length direction perpendicular to the engagement direction, and a portion along a second width direction, and a primary second terminal group and a secondary second terminal group each having multiple second terminals held on the second housing and arrayed along the second length direction, the first housing of the first connector includes a protruding wall standing toward a side of engagement between the first connector and the second connector in the engagement direction and extending along the first length direction, a first peripheral wall standing toward an engagement side in the engagement direction and surrounding an outer periphery of the protruding wall in the first length direction and the first width direction, and a first receiving portion recessed to a side opposite to the engagement side in the engagement direction and positioned between the protruding wall and the first peripheral wall in the first length direction and the first width direction, the primary and secondary first terminal groups of the first connector are each arrayed along the first length direction, and are arranged facing each other with the protruding wall being interposed therebetween in the first width direction, each first terminal includes a first contact portion and a raised curved portion protruding to the engagement side in the engagement direction, the raised curved portion is provided with the raised curved portion being exposed through the first housing, the second housing of the second connector includes a second peripheral wall standing toward the side of engagement between the first connector and the second connector in the engagement direction, arranged in an annular shape in the second length direction and the second width direction, and fitted in the first receiving portion in engageable connection between the first connector and the second connector, and a second receiving portion recessed to the side opposite to the engagement side in the engagement direction, formed inside the second peripheral wall in the second length direction and the second width direction, and configured such that the protruding wall is fitted in the second receiving portion in engageable connection between the first connector and the second connector, the primary and secondary second terminal groups of the second connector are each arrayed along the second length direction, and are arranged facing each other with the second receiving portion being interposed therebetween in the second width direction, each second terminal includes a second contact portion fitted in the first receiving portion in engageable connection between the first connector and the second connector to contact the first contact portion of a corresponding one of the first terminals, and a connection portion protruding outward of the second peripheral wall in the second width direction, a collision surface projecting outward in the first width direction with respect to a top portion of the raised curved portion protruding most to the engagement side and extending along the first length direction is provided on the engagement side of the first peripheral wall, the collision surface is provided in an outer region in the first length direction with respect to an array area of the first terminals included in the primary first terminal group and an outer region in the first length direction with respect to an array area of the first terminals included in the secondary first terminal group, a projecting portion is provided on a side opposite to the engagement side of the second peripheral wall, projects outward in the second width direction with respect to the second peripheral wall, and extends along the second length direction, at least part of the projecting portion collides with the collision surface in disengagement of the first connector and the second connector, part of the raised curved portion positioned outside the top portion of the raised curved portion in the first width direction is provided in a state exposed to an outside, and in the array area of the first terminals included in the primary first terminal group and the array area of the first terminals included in the secondary first terminal group, the first housing form a surface identical to a surface of the part of the raised curved portion provided in the state exposed to the outside.

12. The circuit board connector device according to claim 11, wherein the first length direction is longer than the first width direction, and the second length direction is longer than the second width direction.

13. The circuit board connector device according to claim 11, wherein at least part of the projecting portion is positioned between the connection portion and the collision surface in the engagement direction in disengagement of the first connector and the second connector.

14. The circuit board connector device according to claim 11, wherein at least part of the projecting portion is a portion positioned on an outermost side of an engagement-side surface of the projecting portion in the first width direction.

15. The circuit board connector device according to claim 11, wherein in the engagement direction, an engagement-side surface of the projecting portion and a surface of the second receiving portion opposite to the engagement side are at an identical position.

16. A circuit board connector device comprising:

a first connector and a second connector engageably connected to or disengaged from each other along an engagement direction, wherein the first connector includes a first housing having a portion along the engagement direction, a portion along a first length direction perpendicular to the engagement direction, and a portion along a first width direction, and a primary first terminal group and a secondary first terminal group each having multiple first terminals held on the first housing and arrayed along the first length direction, the second connector includes a second housing having a portion along the engagement direction, a portion along a second length direction perpendicular to the engagement direction, and a portion along a second width direction, and a primary second terminal group and a secondary second terminal group each having multiple second terminals held on the second housing and arrayed along the second length direction, the first housing of the first connector includes a protruding wall standing toward a side of engagement between the first connector and the second connector in the engagement direction and extending along the first length direction, a first peripheral wall standing toward an engagement side in the engagement direction and surrounding an outer periphery of the protruding wall in the first length direction and the first width direction, and a first receiving portion recessed to a side opposite to the engagement side in the engagement direction and positioned between the protruding wall and the first peripheral wall in the first length direction and the first width direction, the primary and secondary first terminal groups of the first connector are each arrayed along the first length direction, and are arranged facing each other with the protruding wall being interposed therebetween in the first width direction, each first terminal includes a first contact portion and a raised curved portion protruding to the engagement side in the engagement direction, the raised curved portion is provided with the raised curved portion being exposed through the first housing, the second housing of the second connector includes a second peripheral wall standing toward the side of engagement between the first connector and the second connector in the engagement direction, arranged in an annular shape in the second length direction and the second width direction, and fitted in the first receiving portion in engageable connection between the first connector and the second connector, and a second receiving portion recessed to the side opposite to the engagement side in the engagement direction, formed inside the second peripheral wall in the second length direction and the second width direction, and configured such that the protruding wall is fitted in the second receiving portion in engageable connection between the first connector and the second connector, the primary and secondary second terminal groups of the second connector are each arrayed along the second length direction, and are arranged facing each other with the second receiving portion being interposed therebetween in the second width direction, each second terminal includes a second contact portion fitted in the first receiving portion in engageable connection between the first connector and the second connector to contact the first contact portion of a corresponding one of the first terminals, and a connection portion protruding outward of the second peripheral wall in the second width direction, a collision surface projecting outward in the first width direction with respect to a top portion of the raised curved portion protruding most to the engagement side and extending along the first length direction is provided on the engagement side of the first peripheral wall, the collision surface is provided in an outer region in the first length direction with respect to an array area of the first terminals included in the primary first terminal group and an outer region in the first length direction with respect to an array area of the first terminals included in the secondary first terminal group, a projecting portion is provided on a side opposite to the engagement side of the second peripheral wall, projects outward in the second width direction with respect to the second peripheral wall, and extends along the second length direction, at least part of the projecting portion collides with the collision surface in disengagement of the first connector and the second connector, and a total of four collision surfaces separated from each other in the first length direction and the first width direction are provided.

17. The circuit board connector device according to claim 16, wherein the first length direction is longer than the first width direction, and the second length direction is longer than the second width direction.

18. The circuit board connector device according to claim 16, wherein at least part of the projecting portion is positioned between the connection portion and the collision surface in the engagement direction in disengagement of the first connector and the second connector.

19. The circuit board connector device according to claim 16, wherein at least part of the projecting portion is a portion positioned on an outermost side of an engagement-side surface of the projecting portion in the first width direction.

20. The circuit board connector device according to claim 16, wherein in the engagement direction, an engagement-side surface of the projecting portion and a surface of the second receiving portion opposite to the engagement side are at an identical position.

* * * * *